US010262602B2

(12) United States Patent
Nagayama et al.

(10) Patent No.: US 10,262,602 B2
(45) Date of Patent: Apr. 16, 2019

(54) ARRAY SUBSTRATE HAVING SHIFT REGISTER UNIT AND DISPLAY DEVICE

(71) Applicant: BOE TECHNOLOGY GROUP CO., LTD., Beijing (CN)

(72) Inventors: Kazuyoshi Nagayama, Beijing (CN); Song Song, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 383 days.

(21) Appl. No.: 14/891,536

(22) PCT Filed: Jun. 2, 2015

(86) PCT No.: PCT/CN2015/080550
§ 371 (c)(1),
(2) Date: Nov. 16, 2015

(87) PCT Pub. No.: WO2016/107069
PCT Pub. Date: Jul. 7, 2016

(65) Prior Publication Data

US 2016/0329021 A1 Nov. 10, 2016

(30) Foreign Application Priority Data

Jan. 4, 2015 (CN) ..... 2015 1 0001826

(51) Int. Cl.
*G09G 3/36* (2006.01)

(52) U.S. Cl.
CPC ..... *G09G 3/36* (2013.01); *G09G 3/3677* (2013.01); *G09G 2300/0408* (2013.01); *G09G 2310/0286* (2013.01); *G09G 2320/0233* (2013.01)

(58) Field of Classification Search
None
See application file for complete search history.

(56) References Cited

U.S. PATENT DOCUMENTS 8,605,029 B2 12/2013 Ohhashi
2005/0206585 A1* 9/2005 Stewart ..... G09G 3/14 345/34

(Continued)

FOREIGN PATENT DOCUMENTS

CN 101354506 A 1/2009
CN 101504829 A 8/2009

(Continued)

OTHER PUBLICATIONS

International Search Report of PCT/CN2015/080550 in Chinese, dated Sep. 2, 2015 with English translation.

(Continued)

*Primary Examiner* — David D Davis
(74) *Attorney, Agent, or Firm* — Collard & Roe, P.C.

(57) ABSTRACT

An array substrate and a display device are disclosed. The array substrate (01) comprises a gate electrode driving circuit (10), the gate electrode driving circuit (10) includes at least two stages of shift register units (SR1-SRn), and each stage of the shift register units (SR1-SRn) is connected with a row of gate lines (Gate1-Gaten). The shift register units (SR1-SRn) include driving modules (D1-Dn) and logical modules (L1-Ln); the driving modules (D1-Dn) include a portion located in a display region (100) of the array substrate. The array substrate can solve a problem that a larger size of a driving TFT in a gate driver on array (GOA) circuit is not conducive to a narrow frame design trend of a display panel.

19 Claims, 7 Drawing Sheets

(56) References Cited

U.S. PATENT DOCUMENTS

| | | | | |
|---|---|---|---|---|
| 2010/0002827 | A1 | 1/2010 | Shih et al. | |
| 2014/0152935 | A1 | 6/2014 | Heo et al. | |
| 2017/0047030 | A1* | 2/2017 | Kim | G02F 1/13454 |

FOREIGN PATENT DOCUMENTS

| | | | |
|---|---|---|---|
| CN | 102201215 | A | 9/2011 |
| CN | 102460587 | A | 5/2012 |
| CN | 102983132 | A | 3/2013 |
| CN | 104021769 | A | 9/2014 |
| CN | 104183225 | A | 12/2014 |
| CN | 104485085 | A | 4/2015 |

OTHER PUBLICATIONS

Notice of Transmittal of the International Search Report of PCT/CN2015/080550 in Chinese, dated Sep. 2, 2015.
Written Opinion of the International Searching Authority of PCT/CN2015/080550 in Chinese, dated Sep. 2, 2015 with English translation.
Chinese Office Action in Chinese Application No. 201510001826.4, dated May 10, 2016 with English translation.
Second Chinese Office Action in Chinese Application No. 201510001826.4, dated Oct. 17, 2016 with English translation.
Third Chinese Office Action in Chinese Application No. 201510001826.4, dated Dec. 19, 2016 with English translation.

* cited by examiner

ARRAY SUBSTRATE HAVING SHIFT REGISTER UNIT AND DISPLAY DEVICE

CROSS REFERENCE TO RELATED APPLICATIONS

This application is the National Stage of PCT/CN2015/080550 filed on Jun. 2, 2015, which claims priority under 35 U.S.C. § 119 of Chinese Application No. 201510001826.4 filed on Jan. 4, 2015, the disclosure of which is incorporated by reference.

TECHNICAL FIELD

Embodiments of the present invention relate to an array substrate and a display device.

BACKGROUND

A Thin Film Transistor-Liquid Crystal Display (TFT-LCD) includes a pixel matrix defined by gate lines and data lines in both horizontal and vertical directions intersecting with each other. For example, when the TFT-LCD displays, a square wave of a certain width is input for each pixel row sequentially from top to bottom by a gate electrode driving circuit on the gate line, so as to perform gating, and then a signal required by each row of pixels is output sequentially from top to bottom by a source electrode driving circuit on the data line. When resolution is higher, output of the gate electrode driving circuit and the source electrode driving circuit of the display is more, and a length of the driving circuit will also increase, which will be detrimental to a bonding process of a module driving circuit.

In order to solve the above-described problem, the display is often manufactured by using a design of Gate Driver On Array (GOA) circuit. A Thin Film Transistor (TFT) gate electrode switching circuit is integrated onto the array substrate of a display panel, so as to form scanning drive for the display panel, so that a bonding region and peripheral wiring space for the gate electrode driving circuit are saved.

SUMMARY

Embodiments of the present disclosure provide an array substrate and a display device, which can solve the problem that a larger size of a driving TFT in the GOA circuit is not conducive to a narrow frame design trend of the display panel.

One aspect of the embodiments of the present invention provides an array substrate, comprising a gate electrode driving circuit, the gate electrode driving circuit includes at least two stages of shift register units, each stage of the shift register units is connected with a row of gate line, and each of the shift register units includes a driving module and a logical module; the driving module includes a portion located in a display region of the array substrate; each of the driving modules is connected with the logical module, the gate line and a first driving signal input terminal, respectively, and under control of a signal output by the logical module, a signal input by the first driving signal input terminal is transmitted to the gate line.

Another aspect of the embodiments of the present disclosure provides a display device, comprising the array substrate as described above.

BRIEF DESCRIPTION OF THE DRAWINGS

In order to clearly illustrate the technical solution of the embodiments of the present disclosure, the drawings of the embodiments will be briefly described in the following; it is obvious that the described drawings are only related to some embodiments of the present disclosure and thus are not limitative of the present disclosure.

Reference signs: (D1, D2 . . . Dn)—driving modules; (L1, L2 . . . Ln)—logical modules; Signal_A-first control signal output terminal; Signal_B-second control signal output terminal; (Gate1, Gate2 . . . Gaten)—gate lines; (Data1, Data2 . . . Datan)—data lines; 01—array substrate; 10—gate electrode driving circuit; Input—first signal input terminal; Reset-second signal input terminal; Output—present stage of signal output terminal; STV—start signal; RST—reset signal; (SRL SR2 . . . SRn)—shift register units; CLK—first driving signal input terminal; VSS—second driving signal input terminal; T1—first driving transistor; T2—second driving transistor; C—capacitor; 200—driving sub-module; T1s—first driving sub-transistor; Cs—sub-capacitor; T2s—second driving sub-transistor; 100—display region; 101—non-display region; 102—pixel unit; 30—semiconductor active layer; 31—via hole; 40—central region; 41—edge region; 201—first logical sub-module; 202—second logical sub-module.

DETAILED DESCRIPTION

In order to make objects, technical details and advantages of the embodiments of the present disclosure apparent, the technical solutions of the embodiment will be described in a clearly and fully understandable way in connection with the drawings related to the embodiments of the present disclosure. It is obvious that the described embodiments are just a portion but not all of the embodiments of the present disclosure. Based on the described embodiments of the present disclosure, those ordinarily skilled in the art can obtain other embodiment(s), without any inventive work, which should be within the protective scope of the present disclosure.

In study, inventors of the present application notices that, the GOA circuit includes a plurality of TFTs, some TFTs control On and Off of part of the circuits in the GOA circuit by two states of turning-on and turning-off, in order to implement logic output of the signal, so the above-described TFT is called as a logical TFT; and some TFTs, in an ON state, can input a scanning signal to the gate line, so that the scanning signal can turn on the pixel unit in the display region through the gate line, and thus, the above-described TFT is called as a driving TFT. Since the scanning signal input into the gate line can control On and Off of a plurality of pixel units located in the same row, load of the gate line is large. As a result, it is necessary to increase a size of the driving TFT.

The size of the above-described driving TFT is generally much larger than a size of the logical TFT. However, since the GOA circuit is disposed in the non-display region of the array substrate and the non-display region corresponds to a position of a frame of the display panel, when the size of the above-described driving TFT is large, it will occupy a lot of layout space, which is not conducive to the narrow frame design trend of the display panel.

Figure 1A:
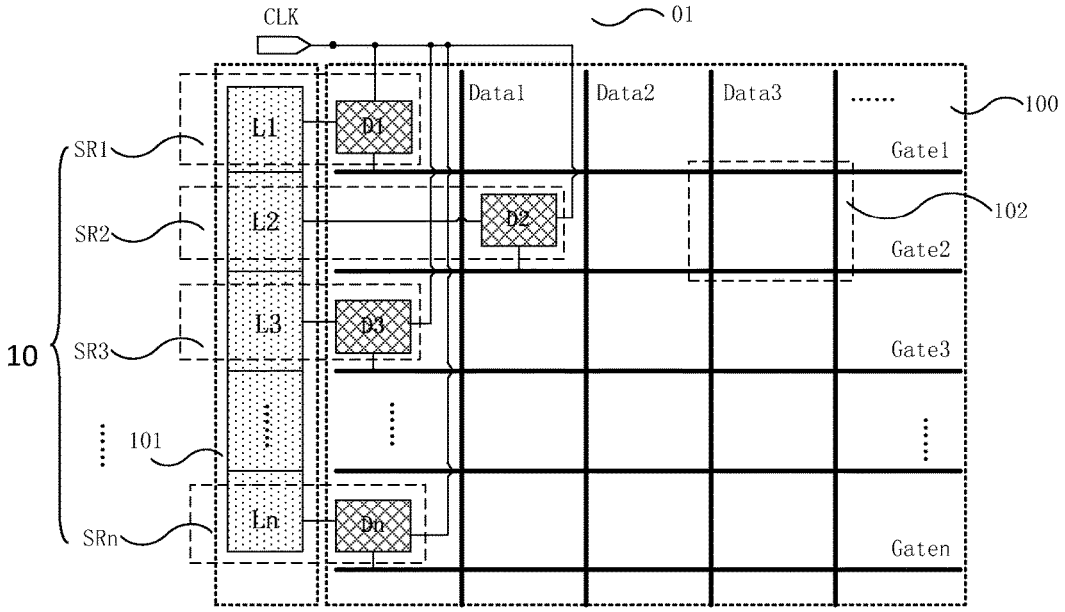
FIG. 1*a* is a structural schematic diagram of an array substrate provided by an embodiment of the present invention.
Figure 1B:
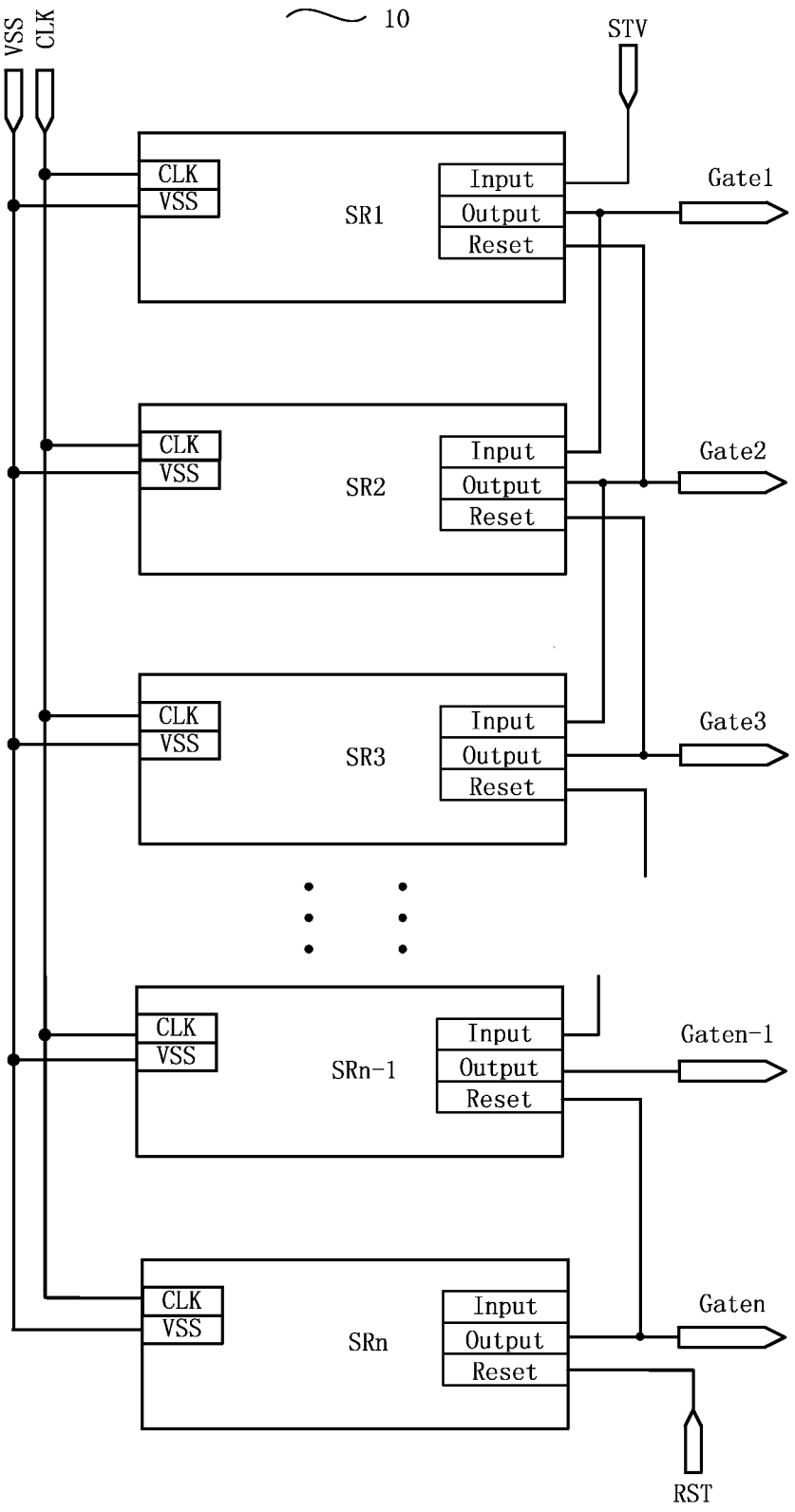
FIG. 1*b* is a structural schematic diagram of a gate electrode driving circuit provided by the embodiment of the present invention.

An embodiment of the present disclosure provides an array substrate 01, which, as illustrated in FIG. 1*a*, may include a gate electrode driving circuit 10. The gate electrode driving circuit 10, as illustrated in FIG. 1*b*, may include at least two stages of shift register units (SR1, SR2 . . . SRn), each stage of the shift register units (e.g., SRn) being connected with a row of gate line (e.g. Gaten). Each of the shift register units (e.g. SRn) may include a driving module (e.g., Dn) and a logical module (e.g., Ln). Where, n≥2 and is an integer.

For example, the driving modules (D1, D2 . . . Dn) include a portion located in a display region 100 of the array substrate 01.

For example, the logical modules (L1, L2 . . . Ln) may be located in a non-display region 101 of the array substrate 01. Alternatively, in some embodiments, the logical modules may also be located within the display region 100 of the array substrate 01.

Each driving module (e.g., D1) is connected with the logical module (e.g., L1), the gate line (e.g. Gate1) and a first driving signal input terminal CLK, respectively; and under control of a signal output by the logical module (e.g., L1), a signal input by the first driving signal input terminal CLK is transmitted to the gate line (e.g., Gate1).

It should be noted that, firstly, the logical modules (L1, L2 . . . Ln) in the embodiment of the present invention may include a plurality of thin film transistors (not illustrated, hereinafter referred to as the logical TFTs) for implementing logical operation. On and off of part of the circuits may be implemented by the above-described logical TFTs, so as to implement the logical operation for output of a control signal, in order to implement shift output. Since load of a logical TFT output terminal is small, a size of the logical TFT is small, which may be generally 10 μm. Therefore, even if the logical modules (L1, L2 . . . Ln) constituted by a plurality of logical TFTs are arranged in the non-display region 101, it will not take up too much space for wiring.

Secondly, a plurality of gate lines (Gate1, Gate2 . . . Gaten) and a plurality of data lines (Data1, Data2 . . . Datan) in both horizontal and vertical directions intersecting with each other within the display region 100 define a plurality of pixel units 102 arranged in matrix. The above-described driving modules (D1, D2 . . . Dn) may include a portion disposed in at least one of the above-described pixel units 102, for example, the driving modules may be disposed within the pixel units 102. Specific positions of the driving modules (D1, D2 . . . Dn) within the display regions 100 are not limited in the embodiment of the present disclosure, for example, different rows of the driving modules may all be disposed within a first column of pixel units 102. As illustrated in FIG. 1*a*, different rows of driving modules may be located within different columns of pixel units 102.

Thirdly, as illustrated in FIG. 1*b*, in the above-described gate electrode driving circuit 10, except the first stage of shift register unit SR1, a first signal input terminal Input of each stage of the remaining shift register units is connected with a signal output terminal Output of a previous stage of shift register unit adjacent thereto. For example, the first signal input terminal Input of the first stage of shift register unit SR1 receives a start signal STV or is input with a reset signal RST.

Except the last stage of shift register unit SRn, a second signal input terminal Reset of each stage of the remaining shift register units is connected with the signal output terminal Output of a next stage of shift register unit adjacent thereto. For example, the second signal input terminal Reset of the last stage of shift register unit SRn may be input with the reset signal RST or receive the start signal SVT.

Fourthly, the number of the shift register units is equal to the number of the gate lines Gate in the display region. That is, the present stage of signal output terminal Output of each stage of the shift register unit is connected with a row of gate line Gate of the display region, so that the input scanning signal is shifted by a plurality of stages of shift registers, in order to implement line sequence scanning for respective rows of gate lines.

With the gate electrode driving circuit 10 illustrated in FIG. 1*b* as an example, scanning in different directions may be implemented according to different input positions of the start signal STV.

For example, when the first signal input terminal Input of the first stage of shift register unit SR1 in respective stages of the shift register units (SR1, SR2 . . . SRn) of the above-described gate electrode driving circuit receives the start signal STV, and the second signal input terminal Reset of the last stage of shift register unit SRn is input with the reset signal RST, the present stage of signal output terminal Output of the respective stages of shift register units (SR1, SR2 . . . SRn) outputs the scanning signal to the gate lines (Gate1, Gate2 . . . Gaten) corresponding thereto in a forward order (from top to bottom) sequentially.

When the second signal input terminal Reset of the last stage of shift register unit SRn in respective stages of shift register units (SR1, SR2 . . . SRn) of the above-described gate electrode driving circuit receives the start signal STV, and the first signal input terminal Input of the first stage of shift register unit SR1 is input with the reset signal RST, the present stage of signal output terminal Output of the respective stages outputs the scanning signal to the gate lines (Gaten, Gaten-1 . . . Gate1) corresponding thereto in a reverse order (from bottom to up) sequentially.

Of course, the above description is only illustrated with the gate electrode driving circuit 10 illustrated in FIG. 1*b* as an example. Gate electrode driving circuits of other structures will not be repeated here, but they all belong to the protection scope of the present invention.

The embodiment of the present disclosure provides an array substrate, comprising a gate electrode driving circuit, the gate electrode driving circuit including at least two stages of shift register units, each stage of shift register units being connected with a row of gate lines. Thereby, the scanning signal may be sequentially input to the gate lines, in order to implement line sequence scanning of the gate lines. In order to implement a shift output function, the shift register unit includes a driving module for inputting the scanning signal to the gate line and a logical module for implementing a shift function by logic output. For example, the driving module is located in the display region of the array substrate; and the logical module is located in the non-display region of the array substrate. The driving module is connected with the logical module, the gate line and a first driving signal input terminal, respectively; and under control of a signal output by the logical module, a signal input by the first driving signal input terminal is transmitted to the gate line. Since load of the gate line is large, the driving module has a larger size, compared to the logical module. So, when the driving module with a larger size is disposed in the display region, a wiring space of the non-display region may be greatly reduced, so as to implement the narrow frame design.

Hereinafter, with specific embodiments, the driving modules (D1, D2 . . . Dn) and the logical modules (L1, L2 . . . Ln) as described above are illustrated.

Embodiment One

Figure 2:
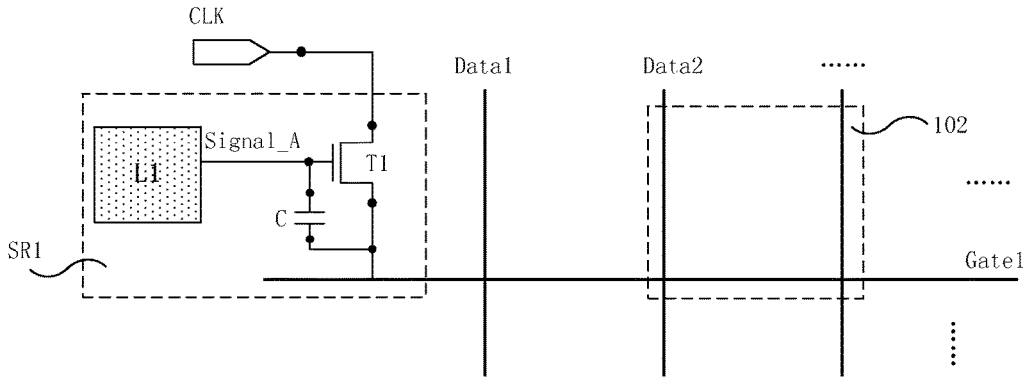
FIG. 2 is a structural schematic diagram of a shift register unit provided by an embodiment of the present invention.

As illustrated in FIG. 2, a driving module (e.g., D1) may include: a first driving transistor T1 and a capacitor C.

The first driving transistor T1 has a gate electrode connected with a first control signal output terminal Signal_A of a logical module (e.g. L1), a first electrode connected with a first driving signal input terminal CLK, and a second electrode connected with a gate line (e.g., Gate1).

The capacitor C has one end connected with the gate electrode of the first driving transistor T1, and the other end connected with the second electrode of the first driving transistor T1.

As a result, when a control signal output by the logical module L1 from the first control signal output terminal Signal_A turns on the first driving transistor T1, the signal input by the first driving signal input terminal CLK may be output as the scanning signal onto the gate line Gate1 corresponding to the shift register unit SR1, so that the gate line Gate1 turns on a row of pixel units 102 connected therewith; and when the data lines (Data1, Data2 . . . Datan) input a data signal, a row of pixel units 102 connected with the gate line Gate1 may display a picture.

In the above-described embodiment, the first driving transistor T1 is used for inputting the scanning signal to the gate lines (Gate1, Gate2 . . . Gaten), and since the load of the gate line is large, the first driving transistor T1 has a large size, which is probably about 1000 μm, much larger than that (which is 10 μm) of the logical TFT for implementing logical operation. Thus, when the first driving transistor T1 with a larger size is disposed in the display region 100, a wiring space of the non-display region 101 can be greatly reduced, so as to facilitate implementing the narrow frame design.

Embodiment Two

Figure 3A:
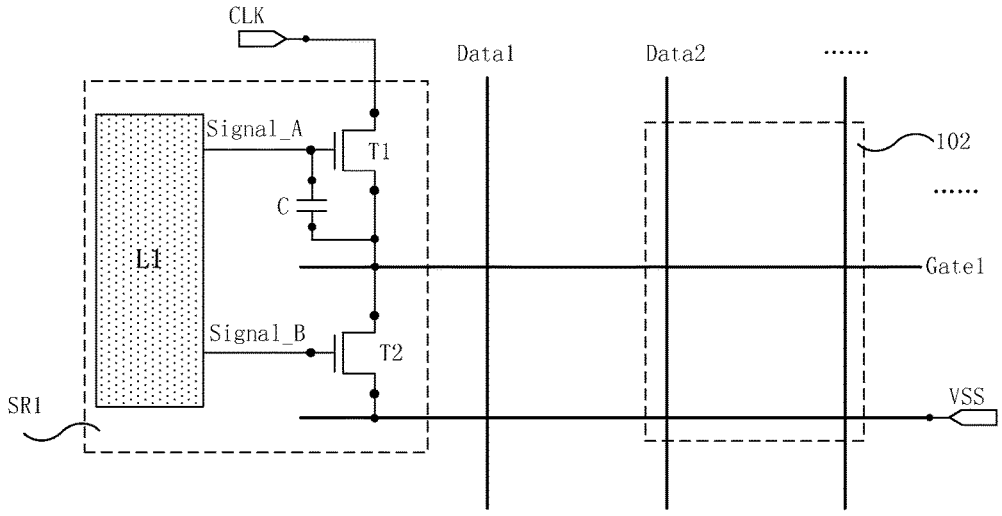
FIG. 3*a* is a structural schematic diagram of another shift register unit provided by an embodiment of the present invention.

As illustrated in FIG. 3*a*, on the basis of Embodiment One, the above-described driving module (e.g., D1) may further include: a second driving transistor T2.

The second driving transistor T2 has a gate electrode connected with a second control signal output terminal Signal_B of the logical module (e.g. L1), a first electrode connected with the gate line (e.g. Gate1), and a second electrode connected with a second driving signal input terminal VSS.

In the embodiment of the present disclosure, it is described with a case where the second driving signal input terminal VSS inputs a low level, or is grounded as an example.

Figure 3B:
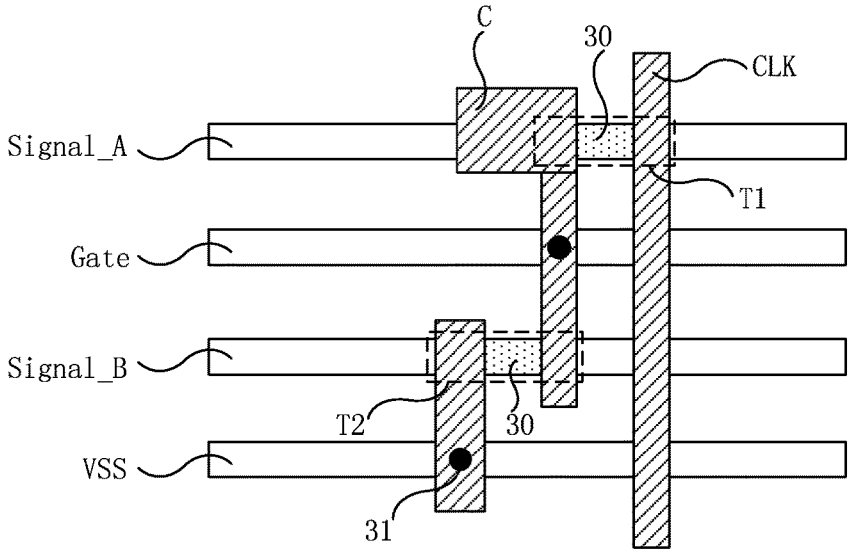
FIG. 3*b* is a connection structural schematic diagram of respective parts in a shift register unit provided by the embodiment of the present invention.

FIG. 3*b* illustrates a wiring connection diagram of the first driving transistor T1 and the second driving transistor T2. The second electrode of the first driving transistor T1 is connected with the gate line Gate through a via hole 31. The second electrode of the second driving transistor T2 is connected with the second driving signal input terminal VSS through the via hole 31. And, a material of a semiconductor active layer 30 of the first driving transistor T1 and the second driving transistor T2 may be an oxide semiconductor active layer, e.g., indium tin oxide, indium zinc oxide; or may be composed of a low-temperature polysilicon; or may further be composed of amorphous silicon. This is not limited by the embodiments of the present invention.

In addition, connection lines of the first electrode and the second electrode (a source electrode and a drain electrode) of the first driving transistor T1, of the first electrode and the second electrode (a source electrode and a drain electrode) of the second driving transistor T2, and of the first driving signal input terminal CLK may be formed by a data metal layer for preparing the data line. A connection line of the first control signal output terminal Signal_A, a connection line of the second control signal output terminal Signal_B and a connection line of the second driving signal input terminal VSS may be formed by a gate electrode metal layer for preparing the gate line Gate.

In summary, in the above-described shift register unit (e.g. SRI), not only in an output stage, the first driving transistor T1 can be turned on by the control signal output by the logical module (e.g. L1) from the first control signal output terminal Signal_A, and the signal input by the first driving signal input terminal CLK may be output as the scanning signal onto the gate line Gate1 corresponding to the shift register unit SR1, but also in a non-output stage, the second driving transistor T2 can be turned on by the control signal output by the logical module L1 from the second control signal output terminal Signal_B, and the signal input by the second driving signal input terminal VSS may be output onto the gate line Gate1 corresponding to the shift register unit SRI; and since the second driving signal input terminal VSS outputs a low level, in the non-output stage of the shift register unit SRL the gate line Gate1 corresponding thereto will not output the scanning signal.

Thus, by providing the first driving transistor T1 and the second driving transistor T2 in the shift register unit SRL in the output stage of the shift register unit SRL the signal of the gate line Gate1 may be pulled up by the first driving transistor T1, in order to scan the gate line Gate1; and in the non-output stage, the signal of the gate line Gate1 may be pulled down by the second driving transistor T2, in order to prevent erroneous output of the scanning signal by the shift register unit in the non-output stage, and to ensure that the gate electrode driving circuit has higher stability and trustworthiness.

In the above-described embodiments, the second driving transistor T2 is used for inputting the low level to the gate lines (Gate1, Gate2 . . . Gaten). The size of the second driving transistor T2, which is generally about 100 μm, is smaller than that of the first driving transistor T1. However, it is still larger than that (which is 10 μm) of a common logical TFT for implementing logical operation. Thus, when the first driving transistor T1 and the second driving transistor T2 which have large sizes are disposed in the display region 100, a wiring space of the non-display region 101 can be reduced, so as to be conducive to the narrow frame design of the display panel.

Embodiment Three

Figure 4A:
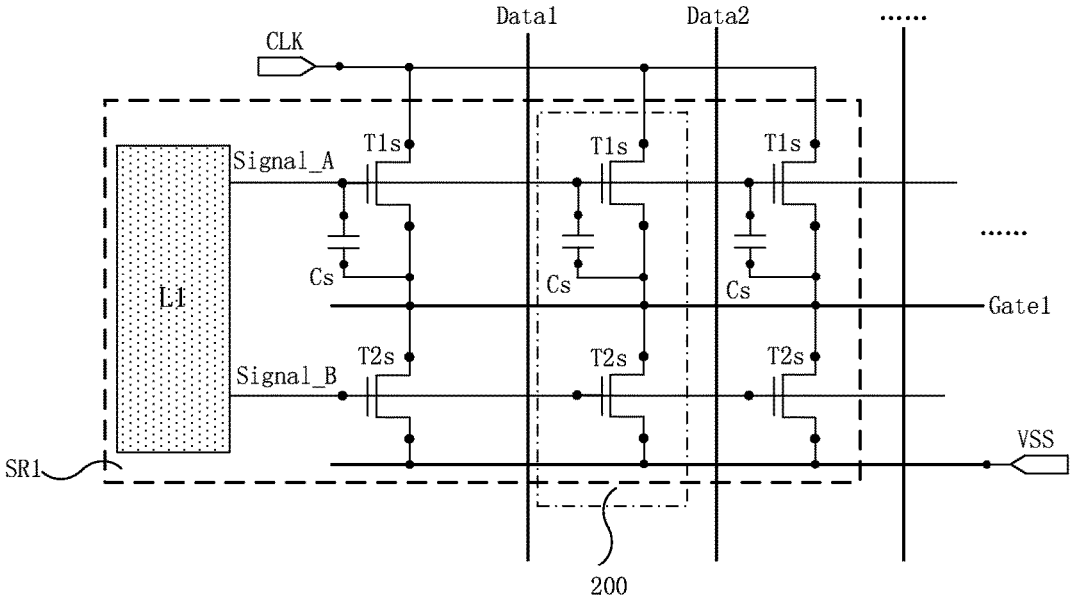
FIG. 4*a* is a structural schematic diagram of another shift register unit provided by an embodiment of the present invention.

As illustrated in FIG. 4*a*, the driving module (e.g., D1) may include at least two driving sub-modules 200, and the driving sub-module 200 may include a first driving sub-transistor T1s and a sub-capacitor Cs.

The first driving sub-transistor T1s has a gate electrode connected with a first control signal output terminal Signal_A of the logical module (e.g. L1), a first electrode connected with a first driving signal input terminal CLK, and a second electrode connected with the gate line (e.g., Gate1).

The sub-capacitor Cs has one end connected with the gate electrode of the first driving sub-transistor T1s, and the other end connected with the second electrode of the first driving sub-transistor T1s.

As a result, when a control signal output by the logical module L1 from the first control signal output terminal Signal_A turns on a plurality of first driving sub-transistors T1s, the signal input by the first driving signal input terminal CLK may be output as the scanning signal onto the gate line Gate1 corresponding to the shift register unit SR1, so that the gate line Gate1 turns on a row of pixel units 102 connected therewith; and when the data lines (Data1, Data2 . . . Datan) input a data signal, a row of pixel units 102 connected with the gate line Gate1 may display a picture.

In the above-described embodiment, a plurality of first driving sub-transistors T1s are used for inputting the scanning signal to the gate lines (Gate1, Gate2 . . . Gaten). As a result, a sum of sizes of the plurality of first driving sub-transistors T1s may be equal to a size of one first driving transistor Ti, that is, the plurality of first driving sub-transistors T1s connected in parallel may be one first driving transistor T1. For example, the size of the first driving transistor T1 is 1000 μm. When the driving module (e.g., D1) may include at least ten driving sub-modules 200, the size of the first driving sub-transistor T1s in each driving sub-module 200 may be 100 μm. In addition, the sub-capacitor Cs is set in a mode the same as described above.

Figure 4B:
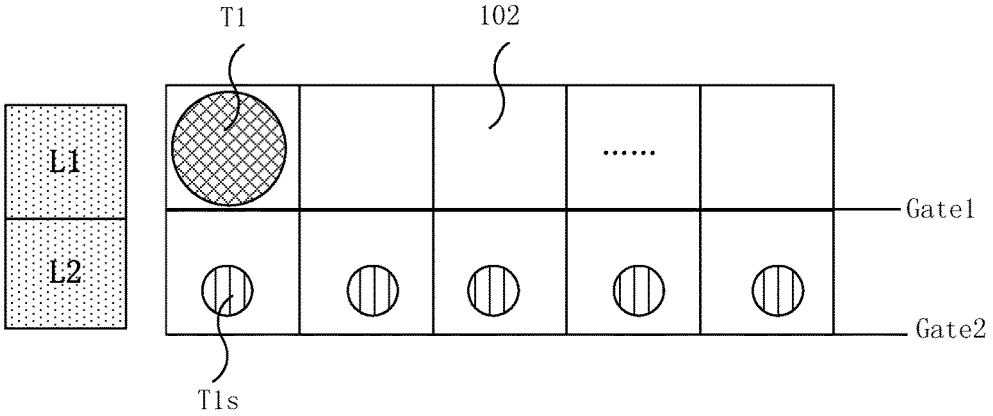
FIG. 4*b* is a size design comparison diagram of a driving transistor in a shift register unit provided by the embodiment of the present invention.

For example, as illustrated in FIG. 4*b*, the shift register unit SR1 for driving the first row of gate line Gate1 includes the logical module L1 located in the non-display region and the first driving transistor T1 located in the first pixel unit 102. The size of the first driving transistor T1 is represented by a circle. It can be seen that, the first driving transistor T1, due to a large size, occupies most of an area of the pixel unit 102, and thus, an aperture ratio of the pixel unit 102 provided with the first driving transistor T1 is low.

However, the shift register unit SR2 for driving the second row of gate line Gate2 includes a logical module L2 located in the non-display region and a plurality of first driving sub-transistors T1s respectively located in different pixel units 102. The first driving sub-transistor T1s is represented by a circle, and the sum of the sizes of the plurality of first driving sub-transistors T1s is equal to the size of the first driving transistor T1. The size of the first driving sub-transistor T1s is smaller than the size of the first driving transistor T1. Therefore, an area of the pixel unit 102 occupied by the first driving sub-transistor T1s is smaller, and an aperture ratio of the pixel unit 102 connected with the second row of gate line Gate2 is larger.

Based on the above-described solution, the driving sub-module 200 may further include: a second driving sub-transistor T2s.

For example, the second driving sub-transistor T2s has a gate electrode connected with the second control signal output terminal Signal_B of the logical module (e.g. L1), a first electrode connected with the gate line (e.g., Gate1), and a second electrode connected with the second driving signal input terminal VSS.

As a result, in the above-described shift register unit (e.g. SR1), not only in the output stage, the first driving sub-transistors T1s can be turned on by the control signal output by the logical module L1 from the first control signal output terminal Signal_A, and the signal input by the first driving signal input terminal CLK may be output as the scanning signal onto the gate line Gate 1 corresponding to the shift register unit SR1, but also in the non-output stage, a plurality of second driving sub-transistors T2s can be turned on by the control signal output by the logical module L1 from the second control signal output terminal Signal_B, and the signal input by the second driving signal input terminal VSS may be output onto the gate line Gate1 corresponding to the shift register unit SR1; and since the second driving signal input terminal VSS outputs a low level, in the non-output stage of the shift register unit SR1, the gate line Gate1 corresponding thereto will not output the scanning signal.

In summary, by providing the plurality of first driving sub-transistors T1s and the plurality of second driving transistors T2s in the shift register unit SR1, in the output stage of the shift register unit SR1, the signal of the gate line Gate1 may be pulled up by the plurality of first driving sub-transistors T1s, so as to scan the gate line Gate1; and in the non-output stage, the signal of the gate line Gate1 may be pulled down by the plurality of second driving sub-transistors T2s, in order to prevent erroneous output of the scanning signal by the shift register unit in the non-output stage, and to ensure that the gate electrode driving circuit has higher stability and trustworthiness.

In the above-described embodiments, the plurality of second driving sub-transistors T2s are used for inputting the low level to the gate lines (Gate1, Gate2 . . . Gaten). As a result, a sum of sizes of the plurality of second driving sub-transistors T2s may be equal to the size of the second driving transistor T2, that is, the plurality of second driving sub-transistors T2s connected in parallel may be one second driving transistor T2. For example, the size of the second driving transistor T2 is 100 μm. When the driving module (e.g., D1) may include at least ten driving sub-modules 200, the size of the second driving sub-transistor T2s in each driving sub-module 200 may be 10 μm.

As a result, on the one hand, when the driving module (e.g., D1) with a large size is disposed in the display region 100, a wiring space of the non-display region 101 can be greatly reduced. On the other hand, since the driving module (e.g., D1) includes a plurality of driving sub-modules 200, when each driving sub-module 200 is disposed in different pixel units 102, respectively, compared to an area occupied when one driving module (e.g., D1) is disposed in one pixel unit 102, the area of the pixel unit 102 occupied by the driving sub-module 200 is greatly reduced, so as to reduce the influence on the aperture ratio of the display panel. Therefore, the above-described embodiment not only can implement the narrow frame design, but also can ensure that the display panel has a higher aperture ratio.

For example, one of the driving sub-modules 200 may be disposed in each pixel unit 102 of the display region 100. As a result, sizes of the first driving sub-transistor T1s and the sub-capacitor Cs in the driving sub-module 200 may be further reduced. Thereby, the influence on the aperture ratio of the display panel is further reduced.

Hereinafter, with specific embodiments, distribution of the plurality of first driving sub-transistors T1s and the plurality of second driving sub-transistors T2s in the display region is illustrated.

Embodiment Four

Figure 5:
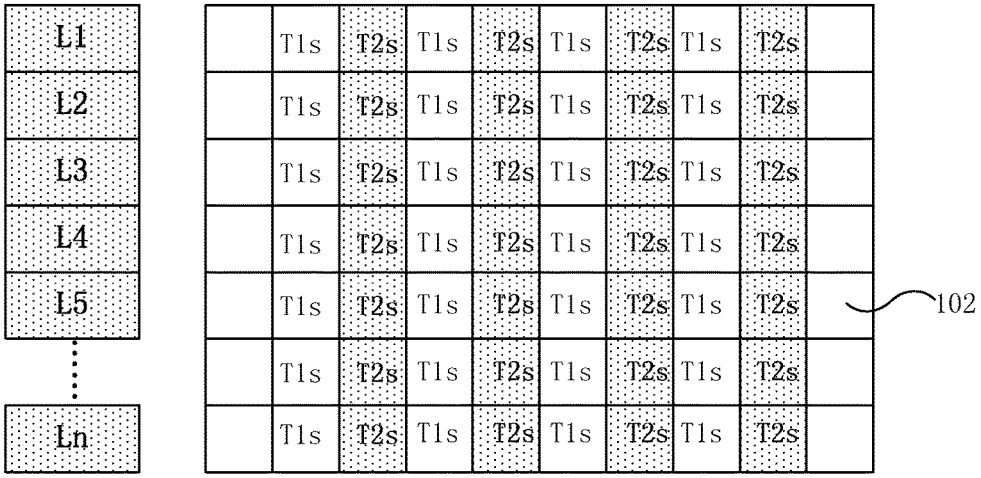
FIG. 5 is a distribution diagram of a driving transistor in a shift register unit provided by an embodiment of the present invention.

As illustrated in FIG. 5, the first-sub driving transistor T1s and the second driving sub-transistor T2s included by each driving sub-module in each stage of shift register unit are located in two adjacent pixel units 102 of the same row, respectively. It should be noted that, FIG. 5 is a simplified schematic diagram, and therefore, specific connection lines of the driving transistor and the logical modules (L1, L2 . . . Ln) as described above are not illustrated.

By the above-described setting method, the first driving sub-transistor T1s and the second driving sub-transistor T2s in each stage of shift register unit may be disposed in different pixel units 102. Therefore, compared to the solution that the driving sub-module 200 is disposed in one pixel unit 102, the above-described solution can further reduce the area of the pixel unit 102 occupied, so that the aperture ratio of the display panel can be increased.

Embodiment Five

For a display panel with high Pixels Per Inch (PPI, number of pixels per inch), the size of the pixel unit 102 is relatively small. Therefore, in order to meet the narrow frame design, a first logical sub-module 201 or a second logical sub-module 202 may be disposed in a position of an edge region 41 adjacent to both sides of a display region 100.

Figure 6A:
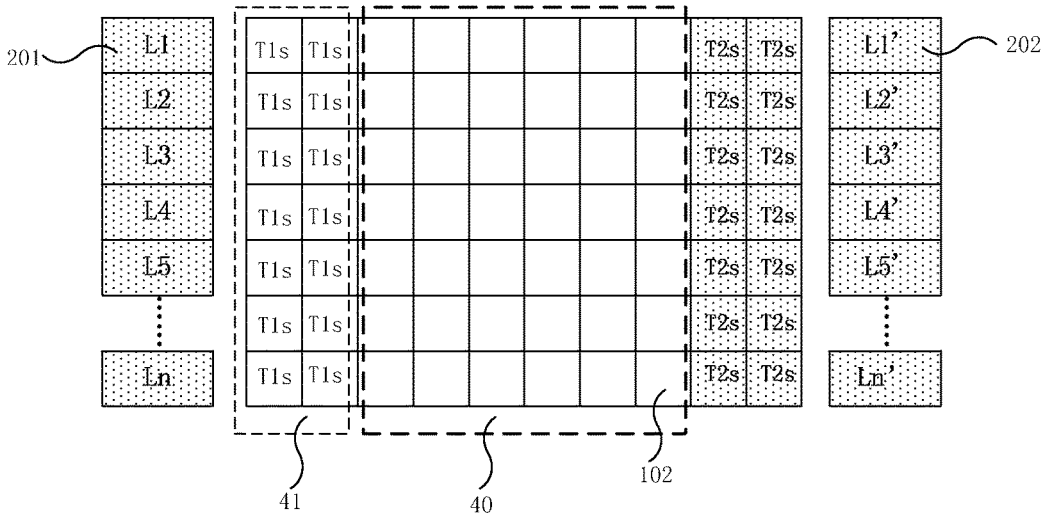
FIG. 6*a* is a distribution diagram of a driving transistor in another shift register unit provided by the embodiment of the present invention.

For example, as illustrated in FIG. 6*a*, the logical modules (L1, L2 . . . Ln) may include the first logical sub-module 201 and the second logical sub-module 202 located on both sides of the display region 100, respectively.

In each stage of shift register unit, the first logical sub-module 201 is connected with a gate electrode of the first driving sub-transistor T1s.

The second logical sub-module 202 is connected with a gate electrode of the second sub driving transistor T2s.

The first driving sub-transistor T1s and the second sub driving transistor T2s are respectively located in the edge region 41 on both sides of a central region 40 of the display region.

The above-described edge region 41 includes at least one column of pixel units 102.

The number of columns of pixel units 102 in the central region 40 is greater than the number of columns of pixel units in the edge region 41.

It should be noted that, firstly, the above-described edge region 41 may refer to several columns of pixel units 102 located on both sides of a display panel and adjacent to the frame of the display panel, and the central region 40 is a region other than the edge region 41 on both sides of the display panel as described above. And, the number of columns of pixel units 102 in the central region 40 is much greater than the number of columns of pixel units 102 in the edge region 41.

Secondly, FIG. 6*a* is a simplified schematic diagram, and therefore, it does not show a specific connection structure of the driving transistor and the logical modules (L1, L2 . . . Ln) as described above.

In the above-described embodiment, the first driving sub-transistor T1s and the second driving sub-transistor T2s are disposed near the edge region 41. Therefore, for the display panel with high PPI, whose pixel unit 102 has a very small size, the driving transistor only occupies a small portion of an effective area of the display region. Therefore, while the narrow frame design is implemented, the influence on the aperture ratio of the display panel can be reduced.

However, in a setting mode as illustrated in FIG. 6*a*, all the first driving sub-transistors T1s of different shift register units are disposed in the edge region 41 on the left side of the display panel, and all the second driving sub-transistors T2s of the shift register unit are disposed in the edge region 41 on the right side of the display panel. The size of the first driving sub-transistor T1s is larger than the size of the second driving sub-transistor T2s, and thus, aperture ratios of the edge region 41 on the left side and the edge region 41 on the right side of the display panel differ greatly, so that display brightness of the picture is uneven, which lowers a display effect.

Figure 6B:
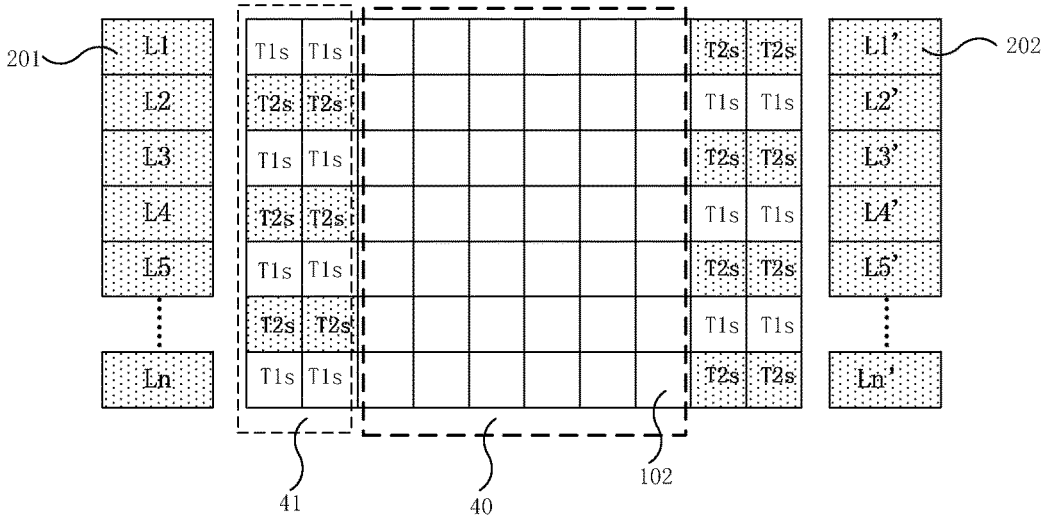
FIG. 6*b* is a distribution diagram of a driving transistor in still another shift register unit provided by the embodiment of the present invention.

Accordingly, in order to solve the above-described problem, as illustrated in FIG. 6*b*, in two adjacent rows of pixel units 102 located on the same side of the edge region 41, each pixel unit 102 in one row corresponds to one first driving sub-transistor T1s, and each pixel unit 102 in the other row corresponds to one second driving sub-transistor T2s. By providing the first driving sub-transistor T1s and the second driving sub-transistor T2s in the adjacent shift register units in a staggered from, areas of the edge regions 41 on both sides occupied by the above-described driving transistors are equal, so that the above-described driving transistors make influence of equal degree on the aperture ratio of the edge regions 41 on both sides. Thereby, the brightness evenness of the picture can be further improved, and the display effect can be enhanced.

Figure 6C:
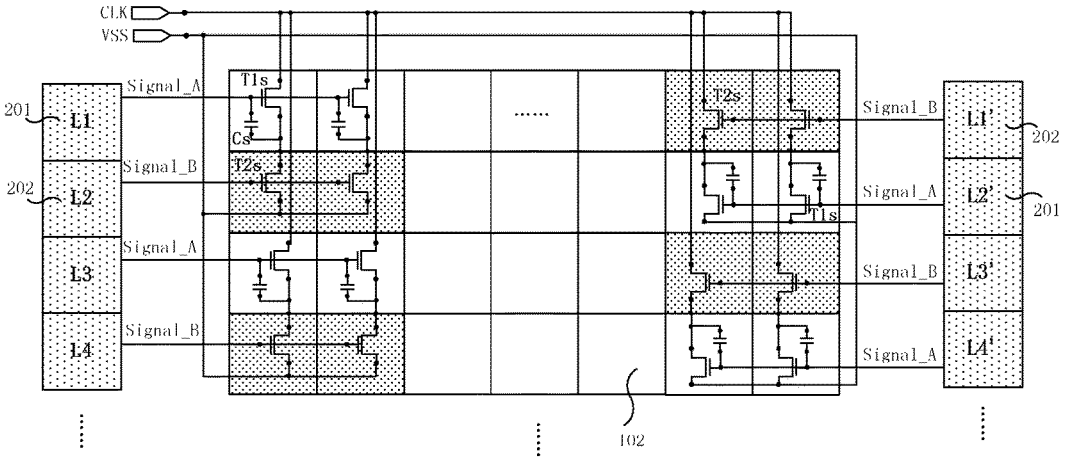
FIG. 6*c* is a connection structural diagram of respective driving transistors in a shift register unit provided by the embodiment of the present invention.

For example, a specific connection diagram of the solution that the first driving sub-transistors T1s and the second driving sub-transistors T2s in the adjacent shift register units are provided in the staggered from is illustrated in FIG. 6*c*. As can be seen, the first driving sub-transistors T1s and the second driving sub-transistors T2s in the adjacent shift register units are provided in the staggered from. Therefore, positions of the first logical sub-module 201 and the second logical sub-module 202 as described above in different rows are also different.

For example, for the first row of pixel units 102, the first logical sub-module 201 (L1) is located in the edge region 41 on the left side of FIG. 6*c*, and the second logical sub-module 202 (L1') is located in the edge region 41 on the right side of FIG. 6*c*. However, for the second row of pixel units 102, positions of the first driving sub-transistor T1s and the second driving sub-transistor T2s of the shift register unit SR2 are interchanged, and thus, the second logical sub-module 202 (L2) is located in the edge region 41 on the left side of FIG. 6*c*, and the first logical sub-module 201 (L2') is located in the edge region 41 on the right side of FIG. 6*c*.

The drawings of the embodiments of the present disclosure are illustrated with a case where the driving module is disposed in the display region of the array substrate as an example, but the embodiments of the present invention are not limited thereto. For example, the first driving transistors in the respective stages of shift register units may be disposed in the display region, and the second driving transistors may be disposed in the non-display region.

An embodiment of the present invention provides a display device, comprising any array substrate as described above. It has a structure and advantageous effect the same as those of the array substrate provided by the above-described embodiments. Detailed descriptions of the structure and the advantageous effect of the array substrate have been provided in the above-described embodiments, and will not be repeated here.

In the embodiment of the present invention, the display device may specifically include a liquid crystal display device or an organic light emitting diode (OLED) display device, and so on; for example, the display device may be a liquid crystal panel, a liquid crystal display, a liquid crystal television, an OLED panel, E-paper, a digital photo frame, a mobile phone or a tablet personal computer, or any other product or component having a display function.

Those of ordinary skill in the art can understand that all or part of the steps of the method for implementing the above embodiments can be performed by program instruction-related hardware, and the corresponding program can be stored in a computer-readable storage medium, i.e., a medium that can store program codes, such as ROM, RAM, magnetic disk or optical disk. When executed, the program can execute the steps included in the embodiments of the above method.

The foregoing embodiments merely are exemplary embodiments of the present disclosure, and not intended to define the scope of the present disclosure, and the scope of the disclosure is determined by the appended claims.

The present application claims priority of Chinese Patent Application No. 201510001826.4 filed on Jan. 4, 2015, the disclosure of which is incorporated herein by reference in its entirety as part of the present application.

The invention claimed is:

1. An array substrate, comprising: a gate electrode driving circuit, wherein, the gate electrode driving circuit includes at least two stages of shift register units, each stage of the shift register units is connected with a gate line, and each of the shift register units includes a driving module and a logical module;

the driving module includes a portion located in a display region of the array substrate;

the driving module is connected with the logical module and a first driving signal input terminal, respectively, and the driving module is directly connected with the gate line and under control of a signal output by the logical module, a signal input by the first driving signal input terminal is transmitted to the gate line.

2. The array substrate according to claim 1, wherein, the logical module is located in a non-display region or the display region of the array substrate.

3. The array substrate according to claim 2, wherein the non-display region is a region around the display region on the array substrate.

4. The array substrate according to claim 2, further comprising: a plurality of pixel units disposed in the display region, wherein, the driving module includes at least a portion located within the pixel unit.

5. The array substrate according to claim 2, wherein, the driving module includes: a first driving transistor and a capacitor, the first driving transistor having a gate electrode connected with a first control signal output terminal of the logical module, a first electrode connected with the first driving signal input terminal, and a second electrode connected with the gate line;

the capacitor having one end connected with the gate electrode of the first driving transistor, and the other end connected with the second electrode of the first driving transistor.

6. The array substrate according to claim 2, wherein, the driving module includes at least two driving sub-modules, and the driving sub-module includes a first driving sub-transistor and a sub-capacitor;

the first driving sub-transistor having a gate electrode connected with a first control signal output terminal of the logical module, a first electrode connected with the first driving signal input terminal, and a second electrode connected with the gate line;

the sub-capacitor having one end connected with the gate electrode of the first driving sub-transistor, and the other end connected with the second electrode of the first driving sub-transistor.

7. The array substrate according to claim 1, further comprising: a plurality of pixel units disposed in the display region, wherein, the driving module includes at least a portion located within the pixel unit.

8. The array substrate according to claim 7, wherein, the driving module includes: a first driving transistor and a capacitor, the first driving transistor having a gate electrode connected with a first control signal output terminal of the logical module, a first electrode connected with the first driving signal input terminal, and a second electrode connected with the gate line;

the capacitor having one end connected with the gate electrode of the first driving transistor, and the other end connected with the second electrode of the first driving transistor.

9. The array substrate according to claim 7, wherein, the driving module includes at least two driving sub-modules, and the driving sub-module includes a first driving sub-transistor and a sub-capacitor;

the first driving sub-transistor having a gate electrode connected with a first control signal output terminal of the logical module, a first electrode connected with the first driving signal input terminal, and a second electrode connected with the gate line;

the sub-capacitor having one end connected with the gate electrode of the first driving sub-transistor, and the other end connected with the second electrode of the first driving sub-transistor.

10. The array substrate according to claim 1, wherein, the driving module includes: a first driving transistor and a capacitor, the first driving transistor having a gate electrode connected with a first control signal output terminal of the logical module, a first electrode connected with the first driving signal input terminal, and a second electrode connected with the gate line;

the capacitor having one end connected with the gate electrode of the first driving transistor, and the other end connected with the second electrode of the first driving transistor.

11. The array substrate according to claim 10, wherein, the driving module further includes: a second driving transistor, the second driving transistor having a gate electrode connected with a second control signal output terminal of the logical module, a first electrode connected with the gate line, and a second electrode connected with a second driving signal input terminal.

12. The array substrate according to claim 1, wherein, the driving module includes at least two driving sub-modules, and the driving sub-module includes a first driving sub-transistor and a sub-capacitor;

the first driving sub-transistor having a gate electrode connected with a first control signal output terminal of the logical module, a first electrode connected with the first driving signal input terminal, and a second electrode connected with the gate line;

the sub-capacitor having one end connected with the gate electrode of the first driving sub-transistor, and the other end connected with the second electrode of the first driving sub-transistor.

13. The array substrate according to claim 12, wherein, the driving sub-module further includes: a second driving sub-transistor;

the second driving sub-transistor having a gate electrode connected with a second control signal output terminal of the logical module, a first electrode connected with the gate line, and a second electrode connected with a second driving signal input terminal.

14. The array substrate according to claim 13, further comprising: a plurality of pixel units disposed in the display region, wherein, each pixel unit of the display region is provided with one of the driving sub-modules therein.

15. The array substrate according to claim 14, wherein, the first driving sub-transistor and the second driving sub-transistor in each stage of the shift register unit are located in two adjacent pixel units of a same row, respectively.

16. The array substrate according to claim 14, wherein, the logical module includes a first logical sub-module and a second logical sub-module located on both sides of the display region, respectively;

wherein, the first logical sub-module of each stage of the shift register unit is connected with the gate electrode of the first driving sub-transistor;

the second logical sub-module is connected with the gate electrode of the second driving sub-transistor;

the first driving sub-transistor and the second driving sub-transistor are located in an edge region on both sides of a central region of the display region, respectively;

wherein, the edge region includes at least one column of pixel units;

a number of columns of pixel units in the central region is greater than a number of columns of pixel units in the edge region.

17. The array substrate according to claim 16, wherein, in two adjacent rows of pixel units located on a same side of the edge region, each of the pixel units in one row corresponds to one of the first driving sub-transistors, and each of the pixel units in the other row corresponds to one of the second driving sub-transistors.

18. The array substrate according to claim 12, further comprising: a plurality of pixel units disposed in the display region, wherein, each pixel unit of the display region is provided with one of the driving sub-modules therein.

19. A display device, comprising the array substrate according to claim 1.

* * * * *